US006622332B2

(12) United States Patent
Furuhashi

(10) Patent No.: US 6,622,332 B2
(45) Date of Patent: Sep. 23, 2003

(54) INSOLE AND A WOODEN SHOE MOLD, AND A METHOD FOR MANUFACTURING SHOES

(76) Inventor: Masanobu Furuhashi, 6-11-1108, Yushima, 4 Chome, Bunkyo-ku, Tokyo (JP)

( * ) Notice: Subject to any disclaimer, the term of this patent is extended or adjusted under 35 U.S.C. 154(b) by 8 days.

(21) Appl. No.: 10/197,344

(22) Filed: Jul. 16, 2002

(65) Prior Publication Data

US 2003/0088927 A1 May 15, 2003

Related U.S. Application Data

(62) Division of application No. 09/582,467, filed as application No. PCT/JP98/05951 on Dec. 25, 1998, now Pat. No. 6,502,266.

(30) Foreign Application Priority Data

Dec. 26, 1997 (JP) ..... 9/367970

(51) Int. Cl.[7] ..... A43D 11/00; A43D 3/00

(52) U.S. Cl. ..... 12/142 R; 12/128 D; 12/141

(58) Field of Search ..... 12/128 D, 141, 12/133 B, 128 C, 128 F, 142 R, 145

(56) References Cited

U.S. PATENT DOCUMENTS

| | | | | |
|---|---|---|---|---|
| 1,825,276 | A | 9/1931 | L'Hollier | |
| 3,084,928 | A | 4/1963 | Opitz | |
| 3,089,166 | A | 5/1963 | Kamborian | |
| 3,106,729 | A | 10/1963 | Kamborian | |
| 3,166,771 | A | 1/1965 | Kline et al. | |
| 4,601,078 | A | 7/1986 | Bertolaja | |
| 5,573,216 | A | 11/1996 | Kuroda | |
| 5,862,555 | A | 1/1999 | Furuhashi | |
| 5,873,651 | A | 2/1999 | Hofer et al. | |
| 6,092,250 | A | 7/2000 | Furuhashi | |
| 6,502,266 | B1 * | 1/2003 | Furuhashi | 12/128 D |

FOREIGN PATENT DOCUMENTS

| | | |
|---|---|---|
| JP | 3039119 Z1 | 7/1997 |

* cited by examiner

*Primary Examiner*—M. D. Patterson
(74) *Attorney, Agent, or Firm*—Charles E. Bruzga

(57) ABSTRACT

The invention provides a freely detachable insole and wooden mold as well as a method of manufacturing shoes, the method using the freely detachable insole and wooden mold, and the method being characterized in that the operation of attaching the insole to the wooden mold can be done in speedy fashion; the alignment of the insole can be easily adjusted even when the insole is attached to the mold not in alignment; there is no danger of failing to pull out nails; and there is no requirement of any special equipment cost. The method of manufacturing shoes comprises the steps of: providing suckers on a wooden shoe mold, attaching the wooden mold and the insole together by such means of causing adherence by suction between a generally flat surface mating the suckers and being provided on the shoe insole and the suckers being provided on the wooden mold made to be freely detachable, and covering the wooden mold by a shoe vamp to thereafter complete a tucking operation.

9 Claims, 5 Drawing Sheets

INSOLE AND A WOODEN SHOE MOLD, AND A METHOD FOR MANUFACTURING SHOES

The present application is a division of application Ser. No. 09/582,467, filed Jun. 26, 2000, now U.S. Pat. No. 6,502,266 which is a 371 of PCT/JP98/5951 filed Dec. 25, 1998.

BACKGROUND OF THE INVENTION

1. Field of the Invention

The present invention relates to a shoe insole and a wooden shoe mold as well as to a method for manufacturing shoes by attaching in a freely detachable manner (or detachably attaching) a shoe insole or inner sole to a wooden shoe mold for facilitating the operation of tucking for the manufacturing process of shoes. More specifically the present invention relates to a shoe insole and a wooden shoe mold, both of which are cost-effective and of a simple construction, and to a method of manufacturing shoes by employing a construction comprising a wooden mold having suckers or sucking discs, which provides the means for attaching in a freely detachable manner, and an insole having a generally flat surface which faces against the suckers.

2. Description of the Prior Art

With reference to FIG. 4, an overview of manufacturing process of shoes in the prior art will be first described. In step (a), a vamp (shoe upper) 11 is formed by sewing or stitching together pieces of genuine or synthetic leather. In step (b), an insole 13 is attached to the wooden shoe mold 12 by applying glues or by driving nails.

Then in step (c), the wooden mold 12 is covered by the vamp 11 thereafter to effectuate the sewing along the lower margin of the vamp 11 to the outer periphery of the insole 13, or in other words, to effectuate the tucking operation. For the purpose of enhancing the adhesion characteristics of a shoe bottom or bottom sole in later steps, the bottom surface of the vamp 11 will be napped.

The steps thereafter may vary depending on the method employed, such as VP manufacturing method, CP manufacturing method, and the like. For example, typically employed CP manufacturing method is described below. In step (d), mid-sole inserts such as a shankpiece 14 and a toe box 15 and the like are incorporated into the insole 13. In step (e), the shoe bottom 16 formed by rubber, leather and the like is made.

Then in step (f), a press 17 is used to glue the shoe bottom 16 to the vamp 11 and to the bottom surface of insole 13 by using an adhesive. A sock lining is put inside of a shoe and attached onto the upper surface of the insole 13. A sole manufacturing is then completed.

PROBLEM TO BE SOLVED BY THE INVENTION

In Japanese Published Laid-open Patent Application No. Hei 06-093753, which was filed by the same applicant as that of the present application, an epoch making invention is disclosed, which method considerably simplifies the conventional manufacturing process of shoes based on driving nails or on bonding by glues. The above invention discloses, as a detachably attaching means which effectuates detachably attaching to a wooden shoe mold, such materials as a magnetically attractive material, hooks, Magic Tape (or Velcro) and the like. Each of such materials has its merits and demerits, and for example, a magnetically attractive material which has a magnetic power suitable for the purpose of the present invention may be expensive, and hooks or Velcro may deteriorate the comfort of shoes because of the parts left in the insole which constitutes one of the members which form the detachably attaching means.

Furthermore, even with the magnetic force of magnetic materials commercially available in the market today, because the magnetic flux density achievable in such materials, although the retention characteristics in the vertical direction with respect to the bottom surface of the wooden shoe mold is suitable, there may be cases in which providing the magnetically attractive material partially in limited regions may not be sufficient and thereby making it necessary to provide the magnetically attractive material over the entire surface of the insole for increasing the retention characteristics in the direction along the same plane as that of the bottom surface of the wooden mold so that they are sufficiently increased to the level required in the actual process of manufacturing shoes, but the cost may be accordingly increased, and thus, the field of applications may be limited.

One of the objects of the present invention is to provide a means for attaching and detaching in a freely detachable fashion, which enables a speedy operation of attaching the insole to the wooden shoe mold, which enables an easy correction of the alignment of the insole even when the insole is attached to the wooden shoe mold in a misaligned fashion, which does not pose such a danger of failing to pull out nails, and which does not require a large increase in the equipment cost, and also to provide a method of manufacturing shoes which uses such a detachably attaching means, wherein the method of manufacturing shoes providing detachable means wherein, even when the insole of a shoe is detachably attached to the bottom surface of a wooden mold, there may be provided the retention characteristics in the same plane as that of the bottom surface of the mold sufficient for the manufacturing of shoes, as well as to provide a method of manufacturing shoes by using such a means.

Furthermore, the present invention makes it also possible to provide an insole attached to the wooden mold where the insole is automatically detached, after a certain period of time elapses, from the wooden shoe mold without requiring any additional operation, and whereby another object of the present invention is to provide a method of manufacturing shoes which is capable of further simplifying the manufacturing process than that of a process which uses a detachably attaching means of the prior art.

MEANS FOR SOLVING THE PROBLEM

In order to achieve the foregoing objects, the insole of the present invention is characterized in that it comprises a generally flat surface which makes the attaching of the insole to the wooden shoe mold to be freely detachable.

The wooden shoe mold in accordance with the present invention is characterized in that there are provided suckers or sucking discs which makes the attaching of the insole of a shoe to become freely detachable. Any sucking means known in the prior arts may be used which provides such effects as similar to that of function of holding or retention obtained by reducing the pressure in the volume space between the sucker and the generally flat surface mating the sucker and being adhered by suction thereby. An example of sucking means may be found in such a means of communicating a decompression pump of prior arts with the foregoing volume formed between the sucker and the generally flat surface.

The generally flat surface in accordance with the present invention may be the surface of the shoe insole itself, or an additional plate having a generally flat surface and being provided on one surface of the insole. In the latter case, the plate having a generally flat surface and the one surface of the insole may be joined with a means known in the art, preferably by using some adhesive, or in some cases, such a plate may be embedded into the insole, or the one surface of the insole may be flattened by any known method including the method of applying to the surface of the insole, for generally flattening the surface of the insole by hardening, some adhesive materials, such as adhesives which may transformed from a liquid state to a solid state by hardening.

In accordance with the method of manufacturing shoes of the present invention, there are provided, as a means for attaching in a freely detachable fashion, suckers in the wooden shoe mold and a generally flat surface on the insole, respectively, while each of the suckers is mating and corresponding to the surface, and thus, the invention is characterized in that the insole is detachably attached to the bottom of the wooden mold, by using any known methods for adhering suckers by suction on a flat surface, to carry out and complete the operation of tucking after covering a vamp on the wooden mold.

In the present invention, the generally flat surface being provided in the shoe insole and mating the suckers provided in the wooden mold may have minute asperities or otherwise grooves so as to control the period of time of the retention of decompression state within the volume formed between each of the suckers and the surface thereby to control the retention force and the retention time provided by the suckers.

In accordance with the present invention, the invention is characterized in that, by detachably attaching the insole to the wooden mold by means of the suckers, the retention force in the direction along the same plane as that of the bottom surface of the wooden mold may be superior to the conventional methods which employ such means as magnetically attractive materials, a chuck or Velcro, and in that; there are provided characteristics similar to that of the detachably attaching technique of the prior art, namely, it is possible to easily correct the alignment of the insole even when it is attached in a misaligned fashion; there is no risk of damaging or smearing the final products; there is no danger of injury due to a failure to pull out nails because no nail is used; there is required no bonding device and; there is a reduction in the equipment cost; the process steps themselves, such as the processes for driving nails, pulling out nails, bonding by glues, scraping off the glue and the like, may be eliminated; and the force of adhesion by sucking provided by the suckers may be controlled by providing minute asperities or otherwise grooves in the region of the surface of the insole where the insole faces against each of the suckers.

In accordance with any one of the detachably attaching techniques in the prior art, after the tucking operation has been completed, a further step is required where some external force is applied in order to separate the insole from the wooden mold by some method. However, the means for attaching in a detachable manner in accordance with the present invention makes it possible to control the adhesion by suction provided by each of the suckers, or to automatically release the state of adhesion by suction provided by the suckers, by appropriately selecting the surface characteristics of the regions of the insole mating the suckers.

SUMMARY OF THE INVENTION

Referring to FIG. 1, there are shown an insole and a wooden shoe mold according to one embodiment of the present invention.

This insole 21 in the figure has thin flat plates 23 and 24 bonded at the toe and heel, respectively, of a flexible plate 22 having a shape of a foot when viewed from the top. The surfaces of said plates 23 and 24 may define the areas each of which is adhered by suction by each of the suckers of the present invention. The flexible plate 22 may be formed from any material that has a surface which can provide a state of decompression in the volume space formed between each of the suckers and the surface mating the sucker, more preferably, the flexible plate 22 may be formed from a material having similar flexibility as that of the insole. Such a material may be found in rubber or vinyl, for example.

If a volume space having the above state of decompression can be formed between the surface of insole 21 itself and the sucker mating the same, it is not necessarily required to have the plates 23 and 24, and it may rather be possible as shown in FIG. 5 to form a generally flat surface, instead of having plates 23 and 24, by placing a layer 50 on an insole portion 52, for instance by coating and hardening some adhesive on portion 52 so as to substantially eliminate the asperities on the surface of insole 21.

As also shown in FIG. 5, one of the present inventions may be formed by embodying layer 50 as a plate to be attached to insole portion 52 over the entire surface of one side of the insole portion 52, instead of using independently separated plates as shown in FIG. 1.

Body 32 of a wooden mold 31 may be made from a wooden piece or synthetic resin so as to fit to the size and shape of a shoe. It should be understood that the term "wooden mold" used herein is not limited to that made from a wooden piece, but the word merely means a mold or last used in the manufacture of shoes. In the present invention, two suckers 33 and 34 are embedded in the bottom 32*a* of the body 32 of wooden mold 31. Furthermore, in some cases, a steel plate 32*b* may be attached to the region of the bottom surface of a wooden mold to prevent the wearing of the bottom surface of the wooden mold. In accordance with the embodiment shown in FIG. 1, the suckers 33 and 34 are provided in locations, each of which is mating the plates 23 and 24, respectively, provided on the insole 21, more specifically in the heel region and toe region.

There may be cases in which, as shown in FIG. 2, the suckers provided in the wooden mold may comprises a plurality of suckers all of which are provided mating against one single surface opposite to the suckers. And thus, by using a plurality of suckers, after the insole is adhered by suction to the suckers and during the operation of tucking, it is possible to reduce the distance of parallel movement of the insole within and along the same surface as that of the bottom surface of the wooden mold. This can be made possible because the larger the size of the cone-shaped suction cup of the sucker, the larger the horizontal or lateral flexibility of the cone-shaped suction cup of the sucker. When using a plurality of suckers in one region, the numbers and sizes, for example, of the suckers may be appropriately selected so that the conditions fall within tolerable ranges required for the operation of tucking.

Furthermore, in some cases, as shown in FIG. 3, within the scope of the present invention, there may be provided in the body 32 of wooden mold 31 a passage way or a channel 41 communicating with a suction pump, one end of which is reaching to the bottom surface of wooden mold 31 and extending through the steel plate 32*b* thereby to provide a passage way 41. The configurations and sizes of the passage way 41, and the numbers and positions of openings 42, for example, may be appropriately varied in accordance with the purpose thereof.

Furthermore, for each of openings 42, in order to facilitate the suction by the suction pump, cones each having the shape similar to that of the cone-shaped suction cup portion of the sucker may be provided so that each of the cones lies open outwardly from the openings 42 by using a material having characteristics identical or similar to the material used for the suckers.

An exemplary embodiment of the method of manufacturing shoes in accordance with the present invention is shown in FIG. 3. In this method, said insole 21 is fixed to the bottom 32*a* of wooden mold 31 by using the force of adherence by suction generated between each of the surfaces of plates 23 and 24 and each of the suckers 33 and 34, respectively. The wooden mold 31 is then covered by a vamp and thereafter to sew or glue the lower margin of the vamp along the outer periphery of the insole 21 (tucking operation).

During the tucking operation, it may be sufficient that the insole 21 is simply held to the wooden mold 31, and thus, the holding force caused by the suckers may be enough because there is no local force applied thereto. By fixing or holding the insole 21 to the wooden mold 31 by the force of adherence by suction by the suckers, it is made possible to easily and rapidly carry out an operation of attaching insole 21 to the mold, and by appropriately selecting the asperities of the surface mating the suckers, the insole may be automatically separated from the suckers after a given period of time has elapsed so that the release from the suckers is done in a manner far more easier than the conventional detachable means of the prior art.

The plates 23 and 24 attached to the insole 21 may be peeled off after the tucking operation is completed, but the plates may be left as they are between the insole and the sock lining. When relatively thinner plates 23 and 24 are used, the influence on the comfort of wearing shoes may be minimized and the plates may reinforce the sole of shoe thereby making it, on the contrary, more preferable.

In the embodiment as have been described above, it can be appreciated by those skilled in the art that it is possible to apply a resin such as an adhesive, for example, on the entire surface of the insole itself, instead of bonding over the entire surface of the insole a plate having a generally flat surface or embedding plate pieces in the insole, thereby making the surface itself having asperities to be a generally flat surface.

[Experiment 1]

In order to compare the force of adhesion by suction provided by the suckers in accordance with the present invention with the retention force provided by the detachably attaching means of the prior arts, comparative experiments were conducted by maintaining the surface area of the region where the sucking discs are applied equivalent to the surface are of the region where the detachably attaching means of the prior arts is applied. Materials Used Were As Follows:

Suckers (Commercially Available Sucking Discs)

Diameter of the cone-shaped portion of the sucker: 25 mm

Material: vinyl chloride

Plates to be Mated with the Suckers

Surface property: as shipped from factory

Material:

Rubber Magnet (Commercially Available Magnet in Sheet Form)

Magnetic flux density: Gauss

Thickness: 0.5 mm

Diameter: 25 mm

Plates to be Mated with the Rubber Magnet

Material: steel

Thickness: 0.2 mm

Results

| | Suckers | Rubber Magnets |
|---|---|---|
| In direction perpendicular to plate surface | Max. 150 grms. | Max. 20 grms. |
| In direction parallel along plate surface | Max. 200 grms. | Max. 5 grms. |
| Duration of effective Adherence by sucking | Max. 24 hrs | approximately infinite |

Note:
The above measurements were made, for the suckers, by loading weights stepwise at an end of thin string fixed to a projection provided at the back side center of a sucker after adhering by suction by the sucker to the plate, and for the rubber magnet, by loading weights stepwise to an end of thin string fixed by an adhesive to the back side of rubber magnet after attaching the rubber magnet to the steel plate. The time period of effective adhesion by suction may defined as the maximum duration of time while the state of adhesion by suction is maintained when it is left under a loaded condition of 50 of the maximum payload in a direction normal to the plane.

[Experiment 2]

In order to control the force of adhesion by suction provided between the sucker and the plate in accordance with the present invention and to control the effective duration of adhesion by suction thereof, other experiments were conducted using the same sucker and plate as used in Experiment 1 above, and measurements on these characteristics were made by changing the surface conditions of the plate to be mated to the sucker by adhesion by suction. The results are shown below. The surface conditions of the plate used were changed by scrubbing the surface for a predetermined number of times with an abrasive paper by fingers, or otherwise by forming by hand a predetermined number of scratches on the surface by using a knife blade.

| | |
|---|---|
| Surface 1 | |
| Abrasive paper: | No. |
| Number of scrubbings: | 1, 2, 5 |
| Surface 2 | |
| Used knife: | a razor blade |
| Number of scratches: | 1, 2, 5 lines |
| Depth of each scratch: | approximately 0.01 mm |

Results

The force of adhesion by suction and the duration of time of effective adhesion by suction (compared with the results of Experiment 1) (%)

| | Surface 1 | | | Surface 2 | | |
|---|---|---|---|---|---|---|
| | 1 time | 2 times | 5 times | 1 line | 2 lines | 5 lines |
| In direction perpendicular to the surface | 70 | 50 | 10 | 85 | 60 | 10 |
| In direction parallel along the surface | 60 | 30 | 0 | 75 | 45 | 0 |
| Duration of | 40 | 10 | 0 | 55 | 35 | 0 |

-continued

| | Surface 1 | | | Surface 2 | | |
|---|---|---|---|---|---|---|
| | 1 time | 2 times | 5 times | 1 line | 2 lines | 5 lines |
| effective adhesion by suction | | | | | | |

Note:
The depth of each surface scratches were estimated by making relative comparisons by the touch of fingers the scratch depth made by abrasion paper.

Figure 1A:
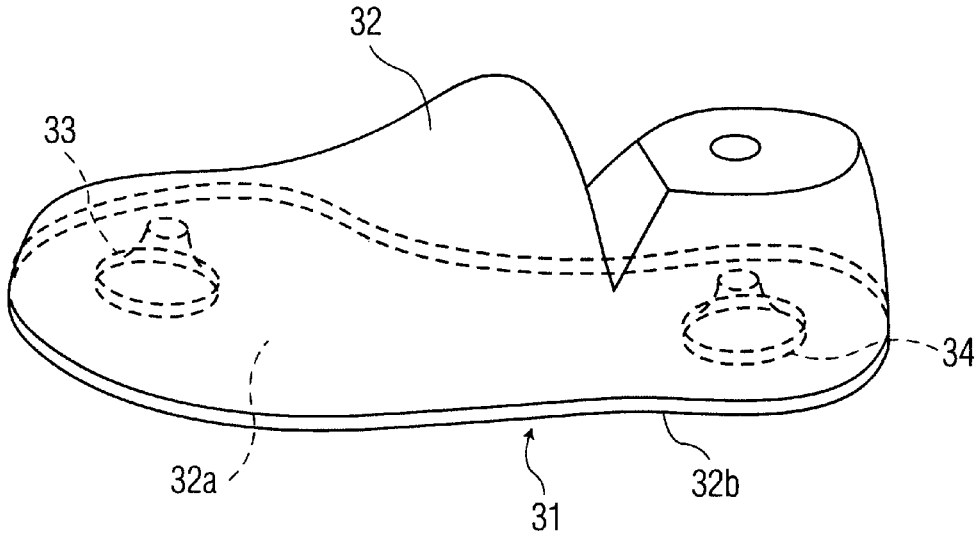
FIG. 1(*a*) is a perspective view of one embodiment of the wooden shoe mold in accordance with the present invention, FIG. 1(*b*) is a perspective view of one embodiment of the insole in accordance with the present invention, and FIG. 1(*c*) is a perspective view of one embodiment of the suckers in accordance with the present invention.
Figure 1B:
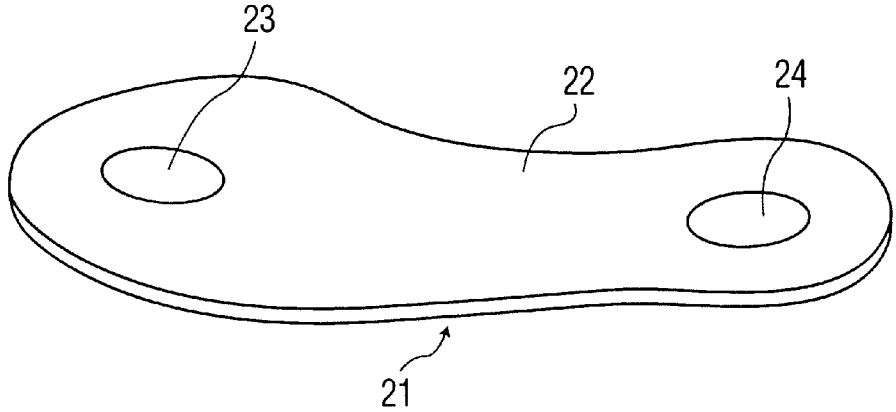
Figure 1C:
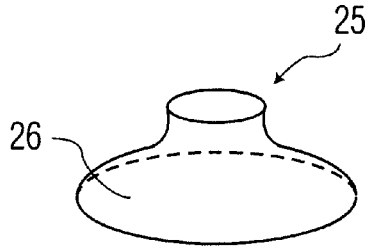
Figure 2A:
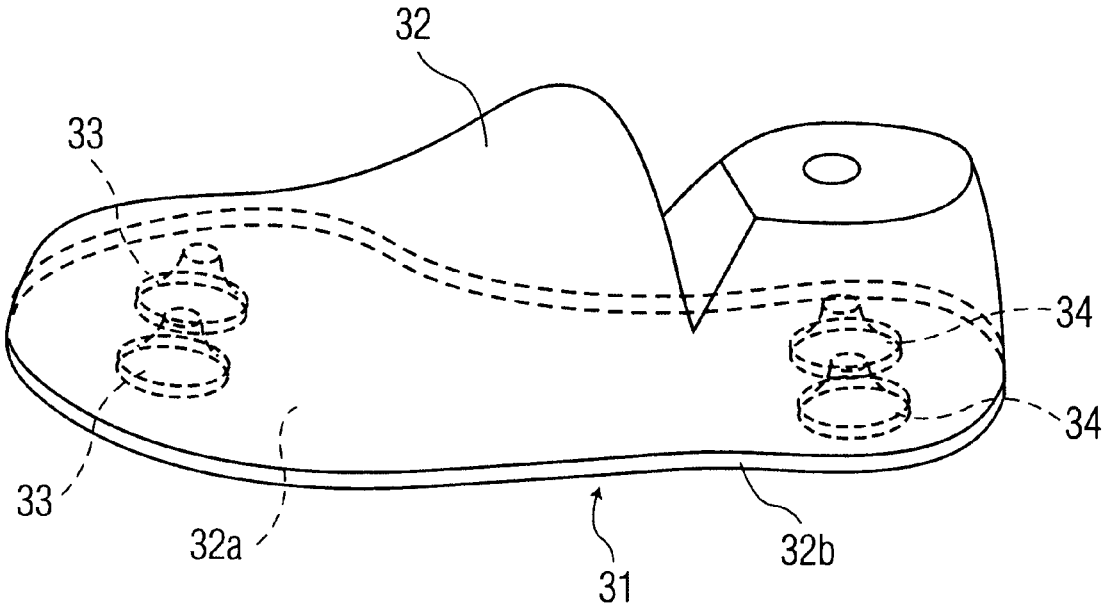
FIG. 2 is a perspective view of another embodiment of wooden shoe mold and the insole in accordance with the present invention.
Figure 2B:
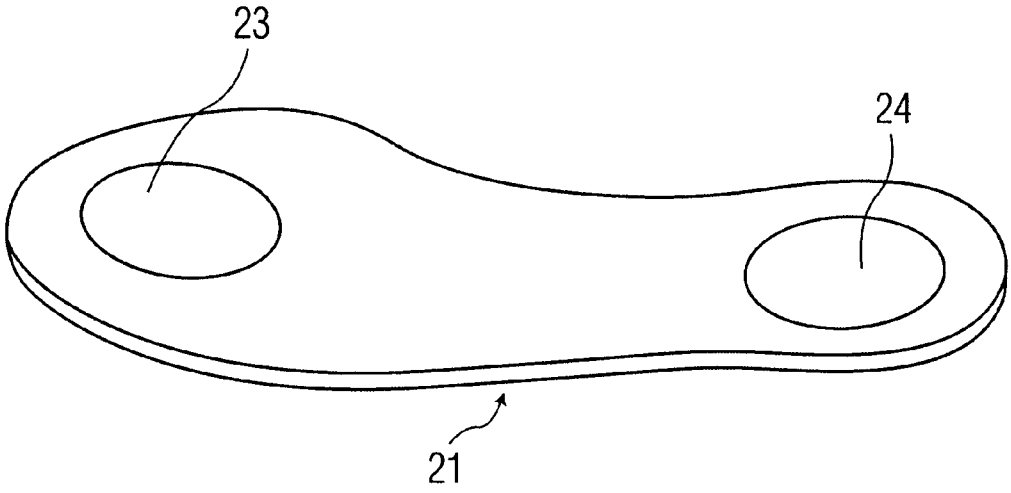
Figure 3A:
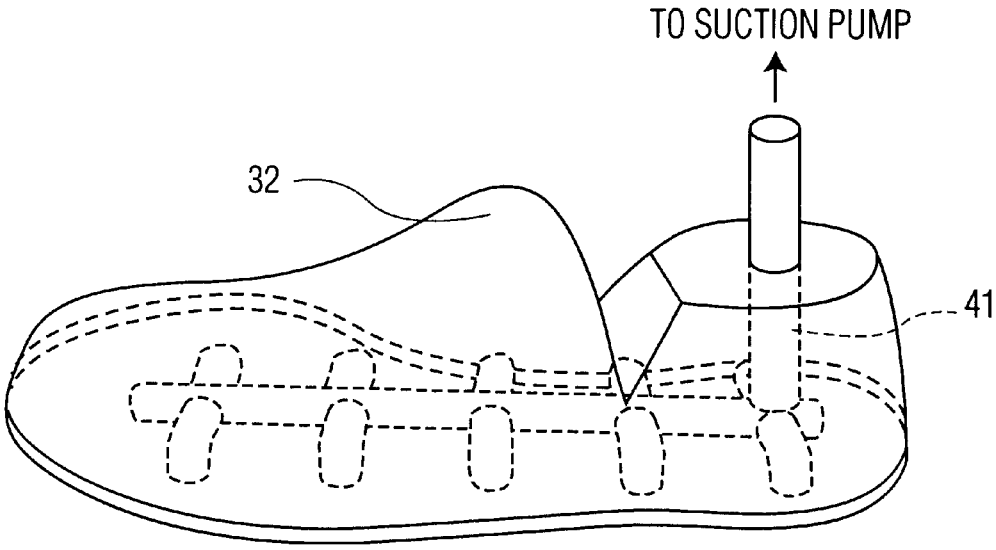
FIG. 3(*a*) is a perspective view of still another embodiment of the wooden shoe mold and the insole in accordance with the present invention, illustrating an embodiment having openings instead of suckers as detachably attaching means, each opening communicating with a suction pump, FIG. 3(*b*) is a plan view of the bottom of the wooden mold shown in FIG. 3(*a*), and FIG. 3(*c*) is a perspective view of yet another embodiment of insole having a generally flat surface over the entire surface of the insole in accordance with the present invention.
Figure 3B:
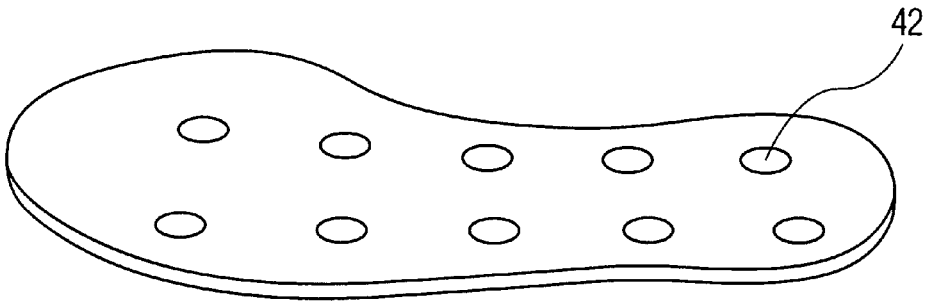
Figure 3C:
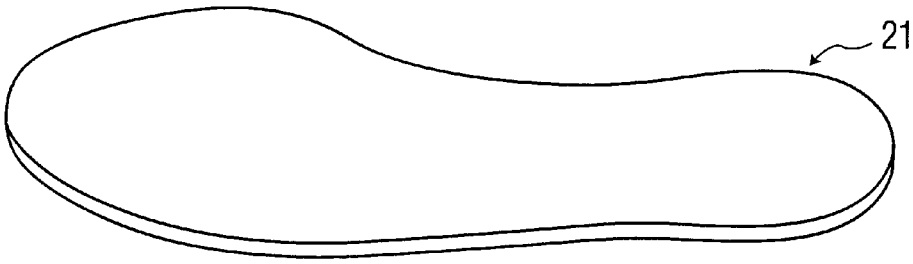
Figure 4A:
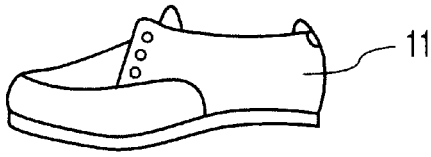
FIG. 4 is a perspective view illustrating the manufacturing process of shoes in general.
Figure 4B:
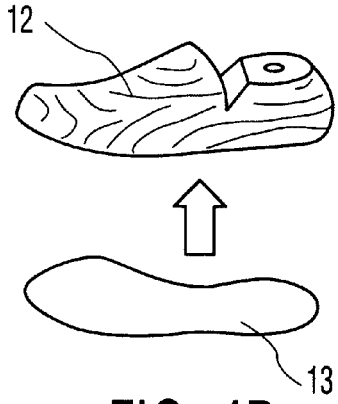
Figure 4C:
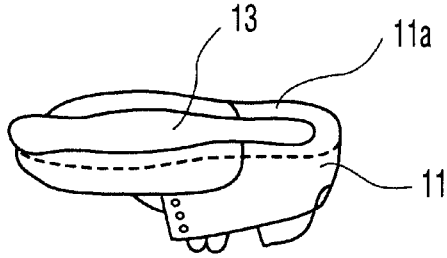
Figure 4D:
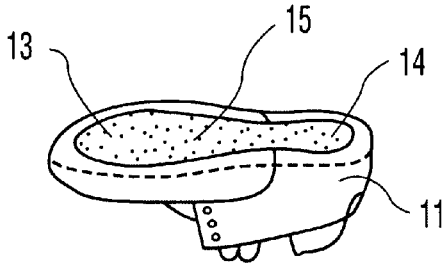
Figure 4E:
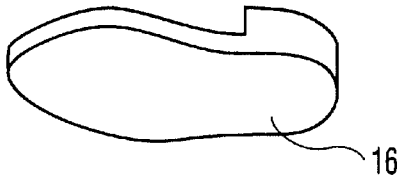
Figure 4F:
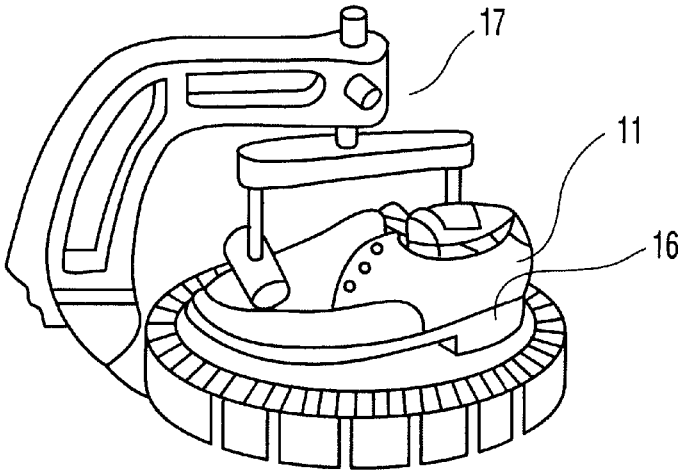
Figure 5:
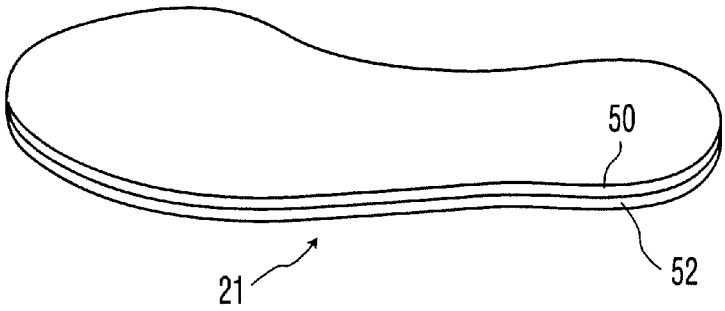

| REFERENCE NUMERALS | |
|---|---|
| 23, 24 | plate having generally flat surfaces |
| 25 | suckers (or sucking discs) |
| 26 | cone-shaped sucking portion of a sucker |
| 31 | wooden shoe mold |
| 32 | body of wooden shoe mold |
| 32a | bottom of wooden shoe mold |
| 32b | steel plate |
| 33, 34 | suckers (or sucking discs) |

EFFECT OF THE PRESENT INVENTION

In accordance with the present invention, an arrangement where, as a means to attach in a detachable fashion an insole to a bottom surface of a wooden shoe mold, suckers are provided on a wooden mold and one or more generally flat surfaces in the regions of an insole surface mating the suckers, respectively, provide substantial improvement in the resistance against the movement of the insole within and along the same plane as that of the bottom surface of the wooden mold when compared with the detachably attaching means of the prior art, while some characteristics of the detachably means of prior arts are maintained; such as easy and speedy attaching of an insole to a wooden mold; considerable shortening of the manufacturing process; easy correction of the alignment of the insole even when the insole is attached in a misalignment to the wooden mold; elimination of the risk of scratching or smearing the final products; complete elimination of a danger caused by failing to pull out nails since no nail is used; no requirement of any special equipment for applying adhesives; and reduction of the equipment cost. Furthermore, the present invention is also characterized in that, by appropriately selecting the combination of the suckers and the flat surface mating therewith, the suckers may be automatically released from the surfaces after a predetermined period of time has elapsed.

What is claimed is:

1. A method of manufacturing shoes, comprising the steps of:

a) providing at least one suction cup on a wooden mold; and b) providing, on the shoe insole for mating at least one suction cup, a generally flat having sufficient irregularities in topology to result in automatic release of the at least one suction cup after a predetermined time has elapsed; and c) pressing said generally flat surface and said at least one suction cup into mating relationship so as to create a suction in the suction cup that holds the insole onto the wooden mold in a freely detachable manner.

2. A method of manufacturing shoes set forth in claim 1, wherein the step of providing at least one generally flat surface comprises providing on said shoe insole a plate having said generally flat surface.

3. A method of manufacturing shoes set forth in claim 2, further comprising the step of gluing the plate to the shoe insole by means of an adhesive.

4. A method of manufacturing shoes set forth in claim 2, wherein said providing on said shoe insole a plate comprises providing a plate that extends over the entire surface of one side of the shoe insole.

5. A method of manufacturing shoes set forth in claim 3, wherein said providing on said shoe insole a plate comprises providing a plate that extends over the entire surface of one side of the shoe insole.

6. A method of manufacturing shoes set forth in claim 2, wherein said providing on the shoe insole a plate comprises embedding a plate in the shoe insole such that the surface of one side of the plate is formed in substantially the same plane as the surface of the shoe insole.

7. A method of manufacturing shoes set forth in claim 1, wherein the step of providing at least one generally flat surface on the shoe insole comprises providing an insole with at least a part of the surface of said shoe insole forming the generally flat surface.

8. A method of manufacturing shoes set forth in claim 1, wherein the step of providing at least one generally flat surface on the insole comprises forming said at least one generally flat surface by applying an adhesive on the insole.

9. A method of manufacturing shoes set forth in claim 1, wherein the step of providing at least one suction cup comprises providing at least one suction cup having sufficient retention force for carrying out the process of tucking.

* * * * *